US006570540B2

(12) United States Patent
Desargant et al.

(10) Patent No.: US 6,570,540 B2
(45) Date of Patent: May 27, 2003

(54) REFLECTOR ASSEMBLY FOR MINIMIZING REFLECTIONS OF ELECTROMAGNETIC ENERGY FROM AN ANTENNA DISPOSED WITHIN A RADOME

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/952,752

(22) Filed: Sep. 14, 2001

(65) Prior Publication Data

US 2003/0052829 A1 Mar. 20, 2003

(51) Int. Cl.[7] ..... H01Q 1/28
(52) U.S. Cl. ..... 343/705; 343/708
(58) Field of Search ..... 343/705, 708, 343/872; H01Q 1/28

(56) References Cited

U.S. PATENT DOCUMENTS

| | | | | |
|---|---|---|---|---|
| 4,581,615 A | | 4/1986 | Levy | |
| 4,677,443 A | | 6/1987 | Koetje et al. | |
| 5,173,699 A | | 12/1992 | Barr et al. | 343/872 |
| 5,231,413 A | * | 7/1993 | Dubois | 343/833 |
| H1219 H | * | 8/1993 | Miller | 343/708 |
| 5,959,590 A | | 9/1999 | Sanford et al. | |
| 6,292,140 B1 | * | 9/2001 | Osterman | 343/700 MS |

FOREIGN PATENT DOCUMENTS

| | | |
|---|---|---|
| DE | 42 23 138 A1 | 6/1993 |
| EP | 0 017 589 A1 | 10/1980 |
| EP | 0 174 579 A2 | 3/1986 |
| GB | 2 120 858 A | 12/1983 |

OTHER PUBLICATIONS

International Search Report dated Dec. 30, 2002, Int'l. App. No. PCT/US02/28116.

* cited by examiner

*Primary Examiner*—Hoanganh Le
(74) *Attorney, Agent, or Firm*—Harness Dickey & Pierce PLC

(57) ABSTRACT

A reflector for use under a radome disposed on a mobile platform such as an aircraft for reflecting a portion of the electromagnetic energy radiated by an antenna disposed under the radome such that the reflected portion of energy impinges the radome at an angle normal thereto, thereby reducing or eliminating further reflections of the reflected portion of energy within the radome toward the mobile platform on which the radome is mounted. In one preferred embodiment the radome includes a base portion which is covered with a cover of radar absorbing material (RAM). In another embodiment the radome includes a curved base portion which is adapted to match the curvature of the surface of the mobile platform on which the reflector is mounted.

19 Claims, 3 Drawing Sheets

FIG 1
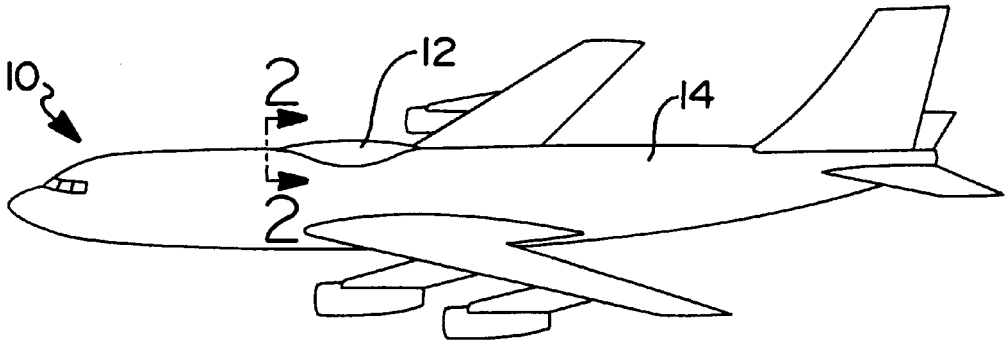
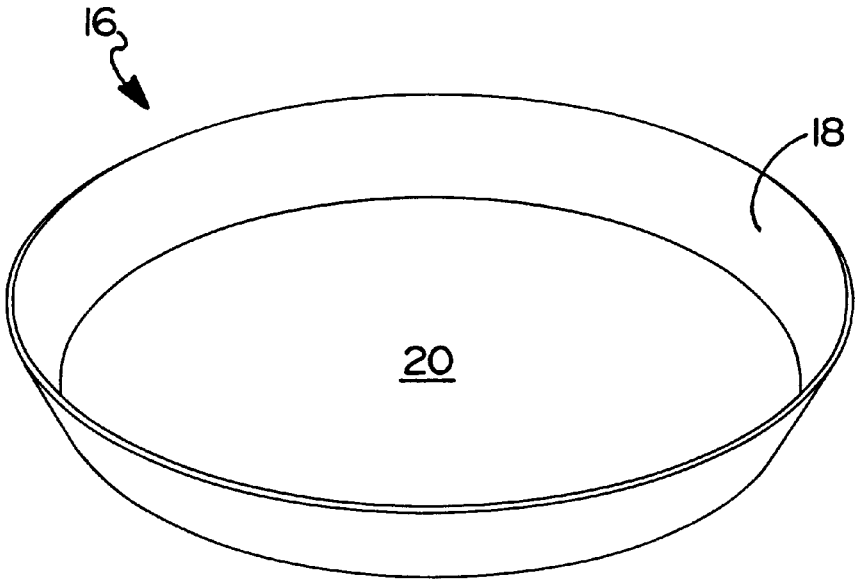
FIG 3

REFLECTOR ASSEMBLY FOR MINIMIZING REFLECTIONS OF ELECTROMAGNETIC ENERGY FROM AN ANTENNA DISPOSED WITHIN A RADOME

FIELD OF THE INVENTION

This invention relates to antenna assemblies, and more particularly to a reflector for use with an antenna disposed within a radome on a mobile platform such as an aircraft for reducing reflections of electromagnetic energy within the radome.

BACKGROUND OF THE INVENTION

Antennas are now being used on the exterior surfaces of commercial aircraft to provide broadband interconnectivity with ground based stations via one or more satellite-based transponders. Such antennas are often electronically scanned phased array antennas, mechanically augmented phased array antennas, or other forms of reflector antennas which are disposed on an exterior surface of the fuselage of the aircraft. The antenna is typically mounted within a radome and radiates its beam through the radome when in a transmit mode of operation.

An undesirable consequence of mounting the phased array antenna within the radome is the creation of reflections of electromagnetic energy caused by the radiated electromagnetic energy impinging the radome at angles other than normal to the interior surface of the radome. However, when electromagnetic energy impinges the radome at an angle normal to the surface of the radome, the great majority of the energy passes through the radome. The problem with reflected energy is particularly acute when the main beam from the antenna is scanned at a scan angle of between about 30°–75° from the boresight of the antenna, which causes the beam to be directed along an axis which is close to parallel to the exterior of the fuselage of the aircraft. At this scan angle, the electromagnetic energy impinges an interior surface of the radome which is tapering toward the fuselage. Electromagnetic energy impinges the interior surface at an angle which is not normal thereto, thus causing a significant degree of energy to be reflected by the interior surface of the radome back toward the aircraft. This situation is highly undesirable as such reflected energy can be directed into the skin of the aircraft, wherein the skin can act as an antenna to further radiate the energy towards other RF receivers or transceivers in the vicinity of the aircraft, and particularly transceivers located on the ground below the aircraft. Since the radome must have a highly aerodynamic shape, it becomes impossible to avoid the problem of reflections within the radome because at such angles as described above (i.e., about 30°–75°), the main beam radiated by the antenna will always be impinging the walls of the radome at angles that are not normal to the interior surface of the radome.

Accordingly, it would be highly desirable to provide some form of reflector within the radome which at least partially circumscribes the antenna to reflect a portion of the radiated electromagnetic energy from the antenna toward the interior surface of the radome such that the reflected electromagnetic energy impinges the interior surface of the radome at an angle normal thereto, thus minimizing the reflections that occur within the radome when the antenna is scanned to an angle greater than about 30° off of its boresight.

It would also be highly desirable to provide such a reflector as described above that does not interfere with operation of the antenna, whether the antenna is an electronically scanned phased array antenna or a mechanically augmented phased array antenna, or other form of reflector antenna, and further which does not require modifications to the shape of the radome or necessitate non-aerodynamic modifications to the contour of the radome.

SUMMARY OF THE INVENTION

The present invention is directed to a reflector for use within a radome mounted on an exterior surface of a mobile platform. In the embodiment illustrated and described herein, the radome is adapted to be secured to an exterior surface of a commercial aircraft.

The reflector comprises a frustoconical member which is adapted to be mounted to the exterior surface of the mobile platform on which the radome is mounted. The reflector, in one preferred form, is circular and completely circumscribes the antenna. In a preferred embodiment the reflector also includes a base portion which forms a planar panel adapted to be disposed against or adjacent to the outer surface of the mobile platform on which the radome is mounted. The base portion can support the antenna directly thereon or can be used to support an intermediate component which itself is supporting the antenna. The reflector, as well as the base, is preferably manufactured from a thin metallic sheet and includes a layer of radar absorbing material (RAM) on an upper surface thereof. The reflector is formed such that it diverges from the outer surface of the mobile platform. The angle of divergence is dependent on the precise contour of the radome.

In the preferred embodiment, at least one independent reflecting plate is disposed on an exterior surface of the mobile platform outwardly of the reflector to further absorb reflected electromagnetic energy that would otherwise be directed by the interior surface of the radome back into the metallized skin of the mobile platform.

The angle of the reflector is further selected based on the contour of the radome, and further such that the reflector will intercept a portion of the main beam radiated from the antenna, when the main beam is scanned at an angle greater than about 30° off of the boresight of the antenna, such that a portion of the radiated electromagnetic energy is reflected by the reflector plate towards the radome and impinges the radome at an angle normal to the interior surface of the radome. In this manner the great majority of the reflected electromagnetic energy from the reflector passes through the radome without the radome causing any further reflections thereof toward the mobile platform.

The reflector of the present invention can thus be used with a wide variety of antennas and does not require modifications to the aerodynamic shape of the radome, which is extremely important in maintaining a smooth aerodynamic profile for the radome.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a side view of a commercial aircraft showing a radome mounted on an exterior surface of a fuselage of the aircraft;

FIG. 3 is a perspective view of the reflector without the antenna of FIG. 2 being mounted thereon.

DETAILED DESCRIPTION OF THE PREFERRED EMBODIMENTS

The following description of the preferred embodiment(s) is merely exemplary in nature and is in no way intended to limit the invention, its application, or uses.

Referring to FIG. 1, there is shown an aircraft 10 upon which a radome 12 is mounted. It will be appreciated immediately, however, that while an aircraft has been illustrated as the mobile platform with which the present invention is to be used, that the present invention can be adapted for use with virtually any other form of mobile platform such as a bus, train, ship or other form of vehicle.

The radome 12 typically has an overall length which is about ten times that of its height to provide a highly aerodynamic profile. The highly aerodynamic profile is extremely important with commercial aircraft to minimize wind drag and therefore minimize the effect of the radome 12 on the performance of the aircraft and its fuel economy. The radome 12 may be mounted directly on an outer surface of the fuselage 14 of the aircraft 10 or to some intermediate component.

Figure 2:
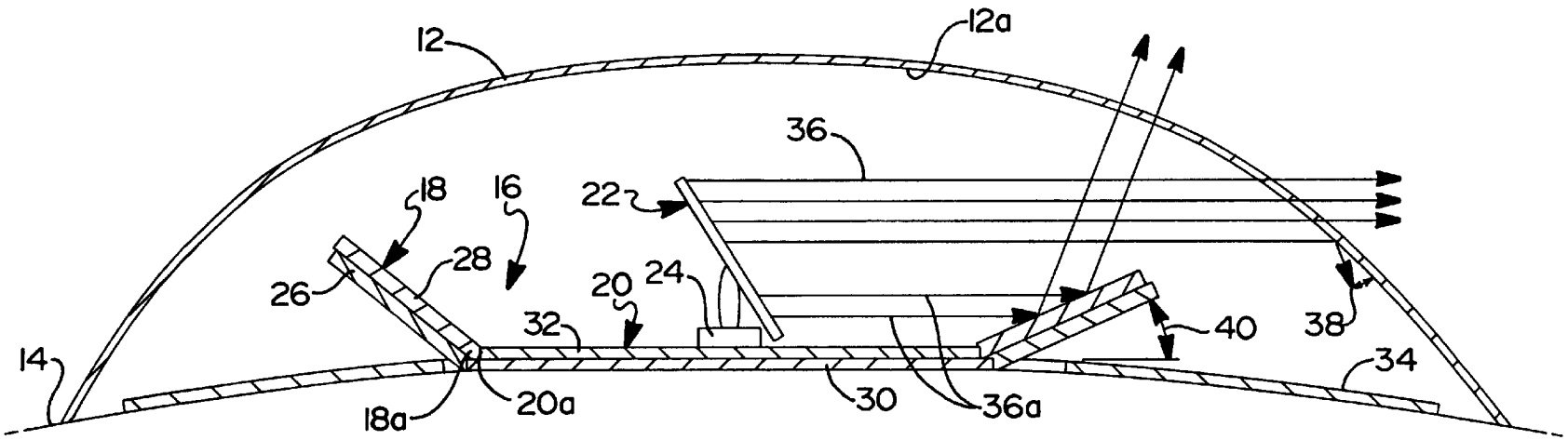
FIG. 2 is a simplified cross sectional view taken in accordance with section line 2—2 in FIG. 1 illustrating the reflector of the present invention disposed so as to circumscribe a phased array antenna supported on the fuselage within the radome.

Referring to FIG. 2, within the radome 12 is disposed a reflector assembly 16 in accordance with a preferred embodiment of the present invention. The reflector 16 includes a frustoconical wall 18 and a base portion 20. Disposed on the base portion 20 is an antenna 22. Antenna 22 may form virtually any type of antenna such as an electronically scanned phased array antenna, a mechanically augmented phased array antenna, a reflector antenna, etc. For purposes of illustration, antenna 22 is illustrated as having a mechanism 24 for rotating and supporting the antenna above the base portion 20 of the reflector 16. Thus, in this example, the antenna 22 takes the form of a mechanically augmented phased array antenna.

The frustoconical wall 18 is preferably formed from a single, relatively thin sheet of metal 26 over which is disposed a layer or radar absorbing material (RAM) 28. Similarly, the base portion 20 is formed from a thin sheet of metal 30 over which a layer of RAM 32 is disposed. An outer periphery 20*a* of the base portion 20 could be secured to an inner periphery 18*a* of the frustoconical wall 18 or could simply be secured to the fuselage 14 adjacent the inner periphery 18*a*. Furthermore, the RAM layer 28 could be comprised of a slightly different material than RAM layer 32. The metallic portion 26 is preferably comprised of a thin sheet of metal, preferably aluminum, and may have a thickness which is sufficient to ensure the necessary structural rigidity thereof. It is anticipated that a thickness of 0.050 inch (1.27 mm) will be sufficient for most applications to provide the necessary structural rigidity. The RAM layer 28 may also vary in thickness but in one preferred form comprises a thickness of about 0.030 inches (0.76 mm).

While the reflector 16 has been illustrated as including the base portion 20, it will be appreciated that the frustoconical wall 18 could be used without the base portion 20 to achieve the necessary redirection of electromagnetic energy, as will be described momentarily. Providing the base portion 20, however, helps to absorb any reflections of electromagnetic energy caused by the radome which would otherwise be directed back toward the fuselage 14 in the vicinity of the antenna 22. If the base portion 20 is included, then a preferred thickness of the metal portion 30 is also preferably around 0.50 inch (1.27 mm). The RAM layer 32 may vary in thickness, but a thickness of about 0.030 inch (0.76 mm) is sufficient to absorb any degree of electromagnetic energy reflected by the radome back towards the fuselage 14 in the vicinity of the antenna 22.

FIG. 2 also illustrates the use of a RAM panel 34 in the form of a doughnut shaped ring which is secured directly to the fuselage 14 outwardly of the outer periphery 20*a* of the base portion 20 of reflector 16. The RAM panel may be comprised of any suitable RAM material and further serves to absorb electromagnetic energy reflected by an interior surface of the radome 12 which is reflected back toward the fuselage 14 of the aircraft 10.

In operation, when the main beam of the antenna 22, indicated by horizontal lines 36 in FIG. 2, is scanned at an angle off of the boresight of the antenna, this causes the main beam to extend along an axis which may be closely parallel, or even parallel, to the fuselage 14 covered by the radome 12. In this instance, the main beam 36 will not be impinging the interior surface 12*a* at an angle normal to the interior surface. When this occurs, a portion of the electromagnetic energy of the main beam 36 will be reflected by the interior surface 12*a* at an angle 38 in FIG. 2 which is identical to the angle between the main beam and the line extending tangent to the radome 12 at the point the main beam impinges the radome. A lower portion of the beam 36, represented by lines 36*a*, is especially troubling because this electromagnetic energy will be reflected toward the fuselage 14 and cannot be absorbed by the reflector panel 34 without the use of an extremely large diameter reflector panel which essentially covers most of the area of the fuselage under the radome 12. Thus, it becomes highly desirable to be able to reflect a portion (i.e., portion 36*a*) of the electromagnetic energy radiated by the lower portion of the antenna 22 to prevent this portion of energy from being reflected by the radome 12 back toward the fuselage 14

The frustoconical wall 18 accomplishes the above objective by presenting a surface in the path of the portion 36*a* of main beam 36. The frustoconical wall 18 is also shown in FIG. 3. In operation, the frustoconical wall 18 of reflector 16 serves to reflect a portion of the electromagnetic energy radiated from the lower portion of the antenna 22 upwardly toward the interior surface 12*a* of the radome 12 such that this reflected energy impinges the interior surface of the radome at an angle normal thereto. In this manner, the reflected electromagnetic energy (represented by lines 36*a*) is able to pass directly through the radome 12 without the radome causing any further significant reflections of this energy. By directing the reflected electromagnetic energy upwardly and away from the fuselage 14, interference with other RF transceivers or receivers on the ground at locations in the vicinity of the aircraft 10 will not be affected by reflected electromagnetic energy, which could otherwise cause interference with such receivers or transceivers. The use of reflector panel 34 further serves to absorb reflected portions of the electromagnetic energy radiated from the antenna 22 which would impinge the fuselage 14 at areas relatively close to the reflector 16.

It will also be appreciated that while the reflector 16 has been illustrated as having a generally uniform, circular shape, as shown in FIG. 3, that the shape of the reflector 16 could be non-circular, and portions thereof could have a greater or lesser angle of inclination than other areas of the frustoconical wall portion 18. The overall shape of the reflector, as well as its angle of inclination 40 relative to the base portion 20 in FIG. 1, is dictated by the precise contour of the radome 12. It is anticipated that in most applications an angle of inclination 40 of between about 5°–75°; and more typically about 10°–45°, will be preferred.

Figure 4:
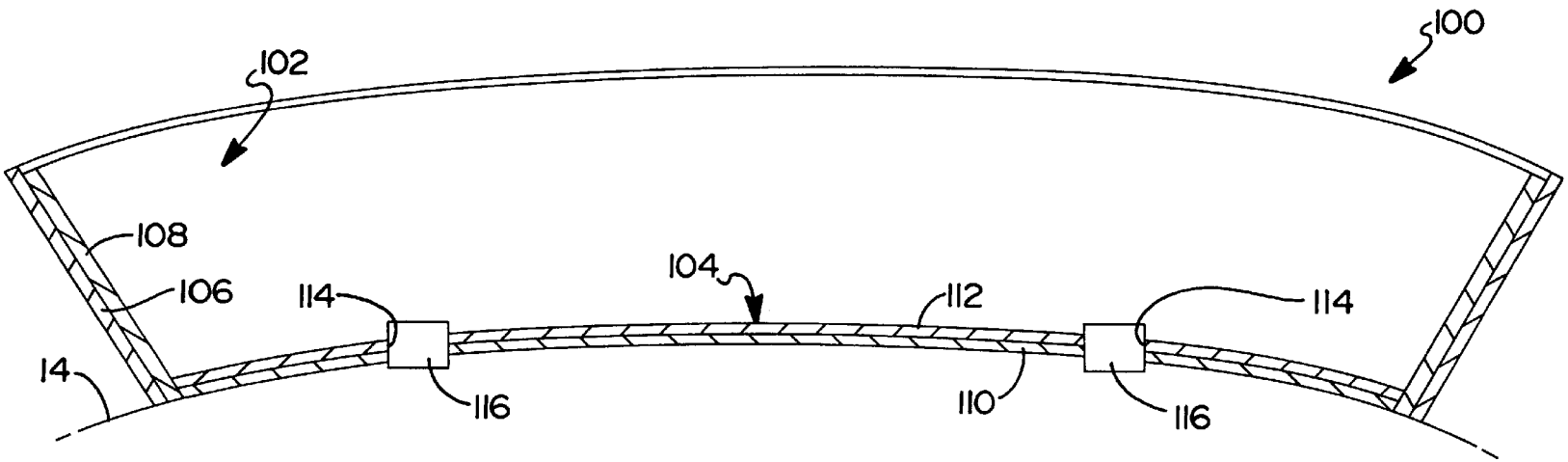
FIG. 4 is a simplified side cross sectional view of a reflector in accordance with an alternative preferred embodiment of the present invention incorporating a base portion having a curvature adapted to match that of the fuselage of the aircraft to which it is to be mounted.

Referring now to FIG. 4, a simplified cross sectional view of reflector 100 in accordance with an alternative preferred embodiment of the present invention is shown. Reflector 100 is similar to reflector 10 in that it includes a frustoconical wall portion 102 and a base portion 104. Frustoconical wall portion 102 similarly includes a metal wall 106 and a RAM layer 108 disposed thereon. Likewise, base portion 104 includes a metal wall 110 and a RAM layer 112 disposed thereon. The principal difference between the reflector 10 and the reflector 100 is that the base portion 104 of reflector 100 has a slight curvature adapted to match the curvature of the fuselage 14 of the aircraft. The base portion 104 further includes openings 114 for enabling suitable fastening elements, represented in highly simplified form by blocks 116, to be used to secure the base portion 104 directly to the fuselage. 14.

The reflectors 12 and 100 of the present invention thus form a means by which a portion of the electromagnetic energy radiated from an antenna mounted on a radome can be reflected at a precise angle so as to impinge the interior surface of the radome at an angle normal thereto, thus substantially reducing or eliminating further reflections of the energy back toward the mobile platform on which the radome is mounted. The preferred embodiments of the reflectors described herein further do not require altering the contour of the radome nor do they require enlarging the cross sectional profile of the radome.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A reflector adapted for use under a radome, wherein the radome is disposed on an exterior surface of a mobile platform and encloses an antenna, for reflecting electromagnetic radiation radiated from said antenna away from said mobile platform, said reflector comprising:

an angled wall disposed on said exterior surface of said mobile platform, said angled wall circumscribing said antenna and extending at an angle so as to diverge from said exterior surface of said mobile platform;

said angled wall operating to reflect a portion of electromagnetic energy radiated from said antenna when said antenna is radiating said energy at a predetermined scan angle which would result in said portion of said energy being reflected by said radome back toward said mobile platform; and said angled wall operating to reflect said portion of said energy toward an interior surface of said radome such that said portion of said energy impinges said radome at an angle generally normal to said interior surface of said radome, to thereby maximize the likelihood of said portion of said energy passing through said radome without being further reflected back toward said mobile platform.

2. The reflector of claim 1, further comprising a base disposed within said angled wall for further absorbing electromagnetic energy reflected by said radome back toward said mobile platform.

3. The reflector of claim 1, further comprising at least one reflection absorbing panel disposed on said exterior surface outwardly of said angled wall for further absorbing electromagnetic energy reflected by said radome toward said mobile platform.

4. A reflector adapted for use under a radome, wherein the radome is disposed on an exterior surface of a mobile platform and encloses an antenna, for reflecting electromagnetic radiation radiated from said antenna away from said mobile platform, said reflector comprising:

a planar base externally disposed from said exterior surface of said mobile platform;

an angled wall circumscribing said base and externally extending at an angle relative to said base;

said angled wall and said angle operating to reflect a portion of electromagnetic energy radiated from said antenna when said antenna is radiating said energy at a predetermined scan angle which would result in a portion of said energy being reflected by said radome back toward said mobile platform; and said angled wall operating to reflect said portion of said energy toward an interior surface of said radome such that said portion of said energy impinges said radome at an angle generally normal to said interior surface, to thereby maximize the likelihood of said portion of said energy passing through said radome without being further reflected back toward said mobile platform.

5. The reflector of claim 4, wherein said angled wall forms a frustoconical member.

6. The reflector of claim 4, wherein said angled wall forms a continuous frustoconical member having a lower edge and upper edge, said lower edge being secured adjacent an outer periphery of said base.

7. The reflector of claim 4, wherein said base comprises a substrate having a radar absorbing material (RAM) disposed thereon.

8. The reflector of claim 4, wherein said angled wall comprises a substrate having a radar absorbing material (RAM) disposed thereon.

9. The reflector of claim 4, wherein said angled wall extends away from a plane oriented parallel to said base at an angle dependent upon a contour of said radome.

10. The reflector of claim 4, wherein said angled wall extends away from a plane oriented parallel to said base at an angle of between approximately 5°–75°.

11. A reflector adapted for use under a radome, wherein the radome is disposed on an exterior surface of a fuselage of an aircraft and encloses an antenna supported by said aircraft, for reflecting electromagnetic radiation radiated from said antenna away from said aircraft, said reflector comprising:

an angled wall circumscribing said antenna and extending outwardly at an angle relative to an external portion of said fuselage supporting said antenna so as to reflect a portion of electromagnetic energy radiated from said antenna when said antenna is radiating said energy at a predetermined scan angle; and said angled wall further operating to reflect said portion of electromagnetic energy toward an interior surface of said radome at an angle generally normal to said interior surface to thereby minimize the possibility of said portion of electromagnetic energy being further reflected by said radome.

12. The reflector of claim 11, further comprising a base disposed within said angled wall portion for further intercepting electromagnetic energy reflected by said interior surface of said radome.

13. The reflector of claim 12, wherein said angled wall has a lower edge portion and said base has an outer periphery, said lower edge portion being joined to said lower periphery.

14. The reflector of claim 12, wherein at least one of said angled wall and said base includes a radar absorbing material (RAM).

15. The reflector of claim 11, wherein said angled wall is comprised of a metallic material.

16. The reflector of claim 11, wherein said angle of said angled wall is determined based at least in part on the contour of said radome.

17. A method for absorbing electromagnetic radiation from an antenna mounted within a radome, which is reflected by said radome back toward a mobile platform on which said radome and said antenna are mounted, said method comprising the steps of:

locating a circumferential angled wall on an external surface of said mobile platform such that said angled wall intercepts a portion of electromagnetic energy radiated from said antenna, wherein said portion would otherwise likely be reflected by said radome back toward said mobile platform; and using said angled wall to redirect said portion of said electromagnetic energy from said antenna toward said radome at an angle relative to said radome which minimizes the possibility of said portion of said energy being reflected by said radome back toward said mobile platform.

18. The method of claim 17, further comprising the step of using a base disposed adjacent to an exterior surface of said mobile platform and within an interior area defined by an edge of said angled wall to further absorb electromagnetic energy reflected by said radome back toward said mobile platform.

19. The method of claim 17, further comprising the step of using a reflecting panel disposed outwardly of an innermost edge of said angled wall, and supported on an exterior surface of said mobile platform, to further absorb electromagnetic energy reflected by said radome toward said mobile platform.

* * * * *